US005525376A

United States Patent [19]

Leonard

[11] Patent Number: 5,525,376

[45] Date of Patent: Jun. 11, 1996

[54] MULTIPLE LAYER COATING METHOD

[75] Inventor: William K. Leonard, Troy Township, St. Croix County, Wis.

[73] Assignee: Minnesota Mining and Manufacturing Company, St. Paul, Minn.

[21] Appl. No.: 382,963

[22] Filed: Feb. 2, 1995

[51] Int. Cl.[6] ..... B05D 1/34; B05C 5/00

[52] U.S. Cl. ..... 427/466; 427/470; 427/598; 427/256; 427/402; 427/356; 427/358; 427/428; 118/411; 118/244; 118/249

[58] Field of Search ..... 427/350, 348, 427/356, 402, 420, 466, 470, 598, 256, 428; 118/63, 410, 411, DIG. 4, 324, 244, 249

[56] References Cited

U.S. PATENT DOCUMENTS

| | | | |
|---|---|---|---|
| Re. 24,906 | 12/1960 | Ulrich . | |
| 2,135,406 | 11/1938 | MacDonald . | |
| 2,139,628 | 12/1938 | Terry . | |
| 2,761,419 | 9/1956 | Mercier et al. . | |
| 2,761,791 | 9/1956 | Russell . | |
| 3,005,440 | 10/1961 | Padday . | |
| 3,508,947 | 4/1970 | Hughes . | |
| 3,632,378 | 1/1972 | Busch . | |
| 3,632,403 | 1/1972 | Greiller . | |
| 3,916,077 | 10/1975 | Damrau . | |
| 4,093,757 | 6/1978 | Barrand et al. . | |
| 4,348,432 | 9/1982 | Huang . | |
| 4,472,480 | 9/1984 | Olson . | |
| 4,504,645 | 3/1985 | Melancon . | |
| 4,748,043 | 5/1988 | Seaver et al. . | |
| 4,978,731 | 12/1990 | Melancon et al. . | |
| 5,234,500 | 8/1993 | Korokeyi . | |
| 5,318,804 | 6/1994 | Yoshida | 427/356 |
| 5,332,797 | 7/1994 | Kessel et al. . | |

FOREIGN PATENT DOCUMENTS

| | | |
|---|---|---|
| 0562975A2 | 9/1993 | European Pat. Off. . |
| 2-173080 | 7/1990 | Japan . |
| 2-207870 | 8/1990 | Japan . |

*Primary Examiner*—Shrive Beck
*Assistant Examiner*—Katherine A. Bareford
*Attorney, Agent, or Firm*—Gary L. Griswold; Walter N. Kirn; Charles D. Levine

[57] ABSTRACT

A plurality of simultaneously applied coating fluids is coated on a substrate by moving the substrate along a path through a coating station. A plurality of flowing layers of coating fluid is formed in face-to-face contact with each other to form a composite layer. This composite layer flows at a speed that is sufficiently high to form a continuous flowing composite layer jet to the substrate surface for the coating width regardless of the direction of flow of the fluid jet.

19 Claims, 2 Drawing Sheets

MULTIPLE LAYER COATING METHOD

TECHNICAL FIELD

The present invention relates to preparing multiple layer coatings. More particularly, the present invention relates to a system for coating a substrate with a plurality of simultaneously applied layers.

BACKGROUND OF THE INVENTION

Coating is the process of replacing the gas contacting a substrate, usually a solid surface such as a web, by a layer of fluid. Sometimes, multiple layers of a coating are applied on top of each other. After the deposition of a coating, it can remain a fluid such as in the application of lubricating oil to metal in metal coil processing or the application of chemical reactants to activate or chemically transform a substrate surface. Alternatively, the coating can be dried if it contains a volatile fluid to leave behind a solid coat such as a paint, or can be cured or in some other way solidified to a functional coating such as a release coating to which a pressure sensitive adhesive will not stick.

Often to create the proper functioning of a coated substrate, multiple layers of differing compositions must be applied. There are many examples of this. It is common to apply a primer coating under a paint to improve the anchorage. In manufacturing color photographic film, as many as twelve layers of differing compositions must be applied in a distinct layered relationship with close uniformity tolerances. The manufacture of high performance magnetic recording tapes requires the coating of multiple layers of magnetic pigments of differing compositions.

Sequential coating operations can produce a plurality of distinct superposed layers on a substrate. However, this is costly, time consuming, and may require a large investment in the sequential coating and drying stations.

Methods of applying simultaneous, multiple layer coatings are discussed in Cohen, E. D. and Gutoff, E. B., *Modern Coating and Drying Technology*, Chapter 4, VCH Publishers, New York, 1992. Slot or extrusion, premetered die coaters are disclosed in U.S. Pat. Nos. 2,761,419 and 2,761,791, and many improvements have been developed over the years. With these coaters, the surface of the web to be coated is brought into contact with or in close proximity to the die surface and a plurality of superposed layers is deposited. Each coating composition is metered to the coating die which deposits the layers on the web. In these methods, the maximum speed of operation is limited and the uniformity of the gap between the die and the web limits the quality of the coatings.

Another method of a simultaneous, multiple layer coating is curtain coating. U.S. Pat. No. 3,508,947 teaches the use of this method with respect to coating photographic elements. Curtain coating uses a free falling vertical curtain of fluid which impinges upon the web traversing the coating station. This patent teaches a method of forming the curtain from a plurality of distinct layers to accomplish a multiple layer coating on the web. The gap between the coating die and the web is much greater than other methods and the speeds of application are substantially greater. However, even this technique has limitations.

To create a multiple layered fluid curtain of miscible layer compositions or coating compositions which have a zero or near zero interfacial tension, the flows of the layers must be kept laminar to avoid mixing. If the preferred slide geometry is used, the maximum flow rate is limited by the transition from laminar to turbulent flow on the slide. If the coating speed is fixed, this limits the maximum coating thickness that may be applied. If the coating thickness is fixed, the maximum speed at which the coating may be applied is limited.

Another limitation of curtain coating is that the free-falling curtain is accelerated by the force of gravity which is constant and limited. The kinetic energy gained in this free fall is used to displace the air from the web surface in a manner to prevent the undesirable entrainment of air. The kinetic energy gain in free fall increases with curtain height, but increased curtain height increases the probability of disturbances to the fragile curtain. In practice, it is difficult to obtain good coating quality with heights above 25 centimeters. This limits the range of thickness and the speed of coating. The desire for high curtains to obtain high speed, thin coatings, and short curtains to obtain high quality coatings are at cross purposes and compromises must be made which restrict the utility of this method. Also, curtain coaters can not function in low or zero gravity environments.

Another limitation of curtain coating is that the curtain always falls vertically under the influence of gravity. This limits the coating station geometries and the coating station orientation. Also, if curtain coating is to be added to an existing manufacturing process, the process must be adapted to the restrictive vertically falling orientation of the curtain rather than orienting the coating die and apparatus to the existing web path of the existing process.

The axisymmetric coater of U.S. Pat. No. 4,348,432 teaches how to form a multiple layer radially expanding sheet from opposed impinging cylindrical multiple layer jets, and how to translate a web past the device to effect a simultaneous, multiple layer coating. However, in addition to the other limitations, this method is severely limited by the maximum web width limitation imposed by the flow dynamics. Widths larger than 1 meter are prohibited and widths larger than 0.75 meters are impractical.

Single layer orifice existing kinetic of fluid issuing from slots are known in the paper industry either to apply an excess of coating liquid to a web surface before metering with a blade coater or to apply an excess of coating liquid to the knurl roll of a gravure coater.

However, no use of multilayer jet coating is known. There is a need for a system that can apply thin multilayer coatings simultaneously, at higher speeds without the orientation, geometric, and gravitational constraints of known coating methods. There is a need for an improved system which can simultaneously coat multiple layers on a substrate with each layer being precisely metered and distributed across the width of the substrate while maintaining the substrate in a controlled juxtaposed face-to-face relationship.

SUMMARY OF THE INVENTION

The system of the present invention coats a plurality of simultaneously applied layered coating fluids onto a substrate. The substrate moves along a path through a coating station, and a plurality of layers of coating fluids of different compositions are flowed in face-to-face contact with each other to form a composite layer. The composite layer flows as a high velocity jet at a speed that is sufficiently high to form a continuous flowing fluid bridge to the substrate surface across the coating width regardless of the direction or the force of gravity. The flowing composite layer jet impinges the substrate to deposit the coating fluids on the substrate. The composite jet fluid bridge has a length greater than the wet caliper of coating fluid applied.

The system also can include depositing the composite layer onto a transfer surface, such as a roll or belt, before contacting the substrate. Also, the system can include an interceptor which interrupts the coating process by blocking the flow before it contacts the web without stopping the substrate or ceasing the other steps.

The fluid bridge may be accelerated by at least one of gravitational, magnetic, or electrostatic forces. However, this is not essential, and the coating can be performed in a low gravity environment. In various embodiments, it is possible to have at least one coating fluid that does not wet the substrate, or is not miscible with an adjacent coating fluid, or has a surface tension differing from an adjacent coating fluid, or is in turbulent flow, or is miscible with an adjacent coating fluid.

DETAILED DESCRIPTION

Figure 1:
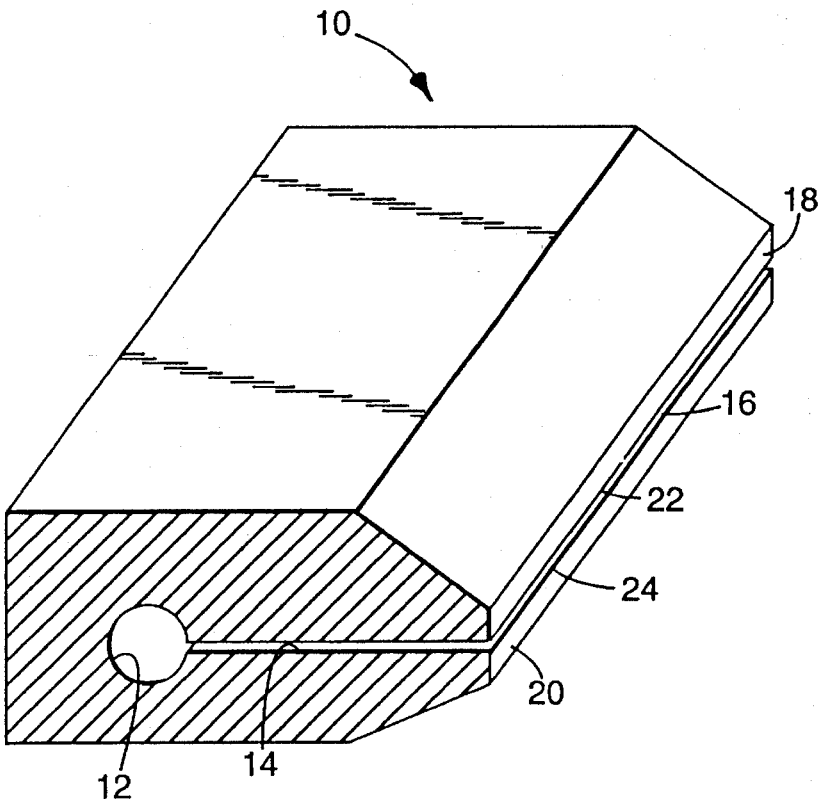
FIG. 1 is a schematic view a jet coating die.

The jet coating device is best understood by referring to the illustration in FIG. 1 which shows a single layer die which may be used for jet coating. The die 10 has a single cavity 12 into which fluid may be pumped through an entrance (not shown). The cavity connects to an exiting slot 14 which allows fluid to exit from the die through the orifice 16 formed where the slot 14 exits the die body 10. Alternatively, the die and its slot exit could be formed by closing one side of a cavity with a thin metal foil which has an orifice cut through it.

The slot 14 is shown as orientated horizontally, perpendicular to the direction of gravity. At low flow rates and in the absence of any substrate or obstruction near the orifice, fluid exiting from the orifice 16 will attach to the lower die face 20 and flow down along it for some measurable distance before breaking free and falling vertically under the influence of gravity.

A jet coating device of this invention is created if the kinetic energy of the fluid issuing from the orifice 16 is large. This occurs at high flow velocities. At these velocities, the fluid issuing from the slot orifice will attach to only the surrounding edges 22, 24 of the orifice 16, breaking cleanly free from the die faces 18, 20, and forming a horizontal flowing orifice-existing kinetic jet fluid. This jet will be expelled horizontally for some visible distance. The flow velocity at which this jet is first formed depends on the slot dimensions, the density of the fluid, the fluid surface tension, and the rheological properties of the fluid. The gap between the coater lips, which define the outlet of the slot 14, and the web is greater than one cm Although this explanation describes a horizontal jet, jets can be created at any angle if the orifice exit velocity is sufficiently high. This is an advantage of jet coaters; jets can be expelled upwardly against the force of gravity or at any angle, and jets can be created in a zero gravity environment.

Figure 2:
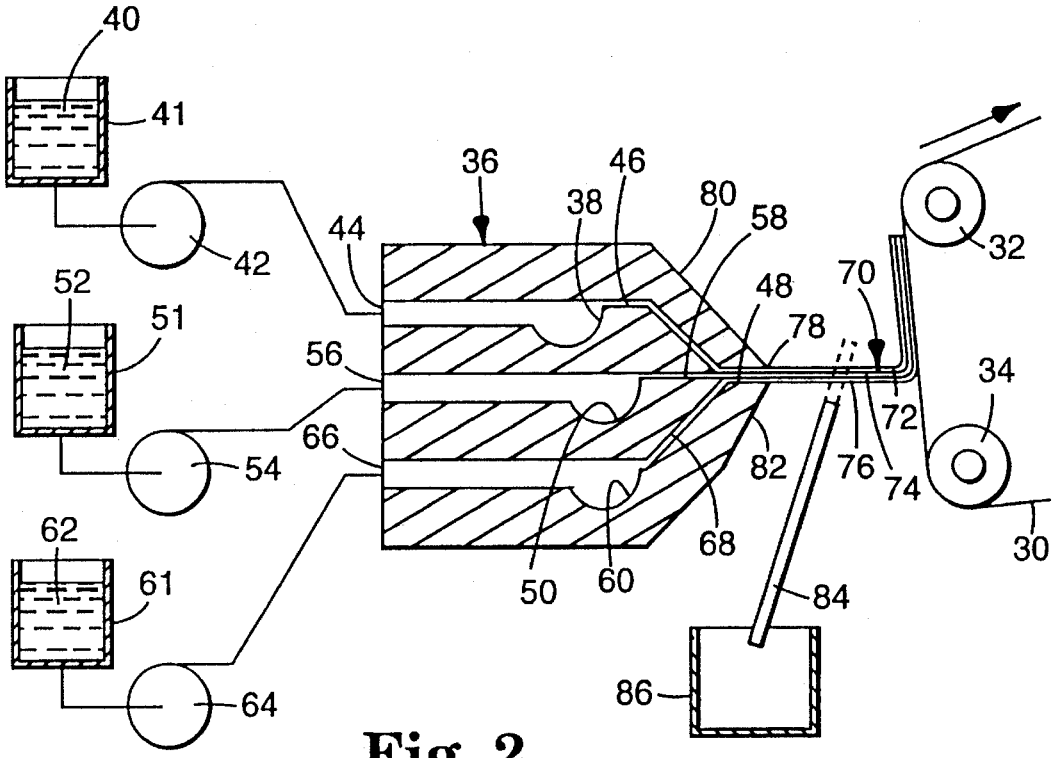
FIG. 2 is a schematic view of the coating system of the present invention.

A multilayer jet coater which coats three layers of fluid simultaneously onto a moving substrate in a superposed layered relationship is shown in FIG. 2. The substrate is a continuous web 30 which is directed through the coating station by rollers 32, 34 which support the web and direct the web substantially upwardly.

A jet coating die 36 is located transverse to the web path. The coating die 36 has a first cavity 38 into which a first fluid coating 40 is pumped at a constant rate by first metering pump 42 through a first inlet 44 from a feed tank 41. The fluid coating 40 flows from the cavity 38 through a first elongated slot 46 to a common slot 48.

The coating die 36 also has a second cavity 50 into which a second fluid coating 52 is pumped at a constant rate by a second metering pump 54 through a second inlet 56 from the feed tank 51. The fluid coating 52 flows from the cavity 50 through a second elongated slot 58 to the common slot 48 where it joins with the coating fluid 40 to form a composite layer flowing fluid stream in the slot 48. The coating die 36 has a third cavity 60 into which a third fluid coating 62 is pumped at a constant rate by a third metering pump 64 through a third inlet 66 from the feed tank 61. The fluid coating 62 flows from the cavity 60 through a third elongated slot 68 to the common slot 48 where it joins with coating fluids 40 and 52 to form a composite layer flowing fluid stream in the slot 48.

Coating fluids 40, 52, 62 flow through the Common slot 48 in a layered, laminar, juxtaposed face-to-face relationship with a combined flow rate large enough to form a composite layered free fluid jet 70 having three distinct superposed layers 72, 74, 76 issuing from a slot orifice 78. The flow velocity through each individual slot 46, 58, 68 can be sufficient to create a jet or not, as long as the velocity through the common slot 48, is sufficient to create the jet. The jet coating die 36 is orientated so that the slot 48 is perpendicular to the force of gravity. In alternative embodiments, the jet flow and the web can be oriented in any direction including upwardly or downwardly flowing jets. The coating method may be used in a low or zero gravity environment and is not encumbered by the gravitational orientation. Surprisingly, the high flow velocity needed to form the fluid Jet does not cause mixing of the multiple layers upon impact with the web 30, and a multilayer coating can be produced.

Alternatively, the coating fluids can be combined into a composite layer before the fluids enter the die which then creates the composite layer jet.

The composite layered fluid jet 70 follows a path which need not be straight. The path is the resultant of the surface forces on its free surfaces, the viscous retarding forces due to the velocity profile changes upon exiting the slot 48, the viscous forces resulting from the acceleration or deceleration of the jet, and any external forces acting upon the jet including magnetic, electrostatic, acoustic, pressure differentials, gravitational, and centrifugal forces. Impingement of the composite fluid jet 70 on the moving web 30 can occur without mixing the layers to deposit on the web a coating of three distinct superposed layers 72, 74, 76. The proper adjustment of the distance from the die orifice 78 to the web 30, and the angle of impingement of the jet with the web are important to obtain continuous layered coatings.

FIG. 2 also shows an interceptor baffle 84 which may be moved upward by a driver (not shown) to intercept the jet 70 before it impinges the web 30. The baffle 84 is used when gravity is present to facilitate start-up and shut-down procedures and can stop the coating operation without stopping the web or the flow of the coating fluids. When the baffle 84 intercepts the coating fluid jet 70 as shown by the broken lines, coating fluid will run down the baffle and into a catch pan 86.

In FIG. 2, the combined flow rate of the layers forming the jet 70 for some fluids is generally greater than 1.5 cubic centimeters per second per centimeter of jet width. To maintain the distinct layered relationship of the coating upon the web 30, turbulence in the individual layers 72, 74, 76 must be avoided if the interfacial tensions are low or if the layers are miscible. If there is a high interfacial tension, some turbulence may occur without disrupting the interface.

The combined wet thickness of the layers 72, 74, 76 of coating deposited on the moving web 30 will be the same as the thickness of the multiple layer jet before impingement when the velocity of the web 30 surface equals the impinging jet speed just before contact. When the velocity of the substrate is greater than the impinging jet speed, the combined wet thickness of the layers deposited will be less than the thickness of the jet just before impingement. Faster substrate speeds will produce thinner coatings. Very high substrate speeds are possible as long as the kinetic energy of the impinging jet is sufficient to displace the air on the surface of the web in a sufficiently uniform and stable manner. When the velocity of the substrate is less than the impinging jet speed, the combined wet thickness of the layers on the substrate will be greater than the thickness of the jet just before impingement. Depending on many factors, the impact of the jet may cause a "fluid heel" to form on the approach side (the side from which the web approaches the jet) of the web at the impingement point. When this becomes large, the quality of the layer coating may suffer or mixing may occur. Factors that influence this are the flow properties of the layers, the surface and interfacial tension of the layers, the angle of impact with the substrate, external body forces, and external pressure gradients. Layer flow rates, substrate speed, jet die distance from the substrate, and the angle of impingement are the primary variables to be changed to stabilize the contacting of the jet to the substrate.

Many different die geometries can be used to produce a multiple layer Jet. Multiple fluid streams can be brought together before entering a single die cavity and then be spread in layered relationship within the cavity before exiting from a single die slot. A jet of fluid can be formed from a die slot with additional layers attached external of the jet orifice shown in FIG. 3. The jet can be either a single layer or a composite layer to which additional layers are added externally. Also, multiple jets from separate orifices from one or many dies may be combined in midair after they have left the respective orifices to form composite jets. Also, the lips of the jet orifice may be offset.

Figure 3:
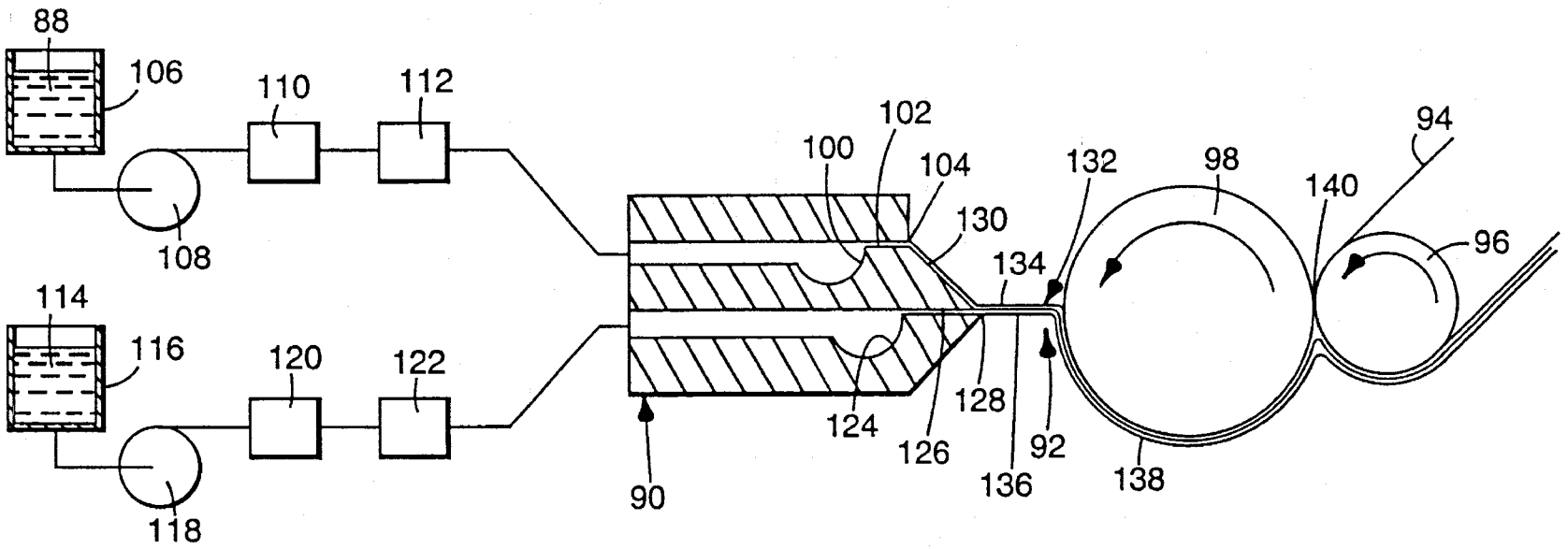
FIG. 3 is a schematic view of the coating system according to another embodiment of the present invention.

The composite layer can be deposited onto a transfer surface, such as a roll or belt, before the contacting the substrate step. FIG. 3 shows a simultaneous two layer coating apparatus. Coating fluid 88 passes through the die 90. A coating station 92 is located next to the die 90. A continuous web 94 passes through the coating station 92 and around a driven roll 96 with a resilient rubber covering. A transfer roll 98 rotates counterclockwise and is in rolling contact with the driven roll 96. The coating die 90 has an internal cavity 100 that is connected to a slot 102 and an orifice 104. This cavity 100 is connected to a tank 106 by a precision metering pump 108 through a filter 110 and a bubble trap 112.

The second coating fluid 114 is supplied from a tank 116 and is metered by a pump 110 through a filter 120 and a bubble trap 122 into a cavity 124 in the die 90. From the cavity 124, it flows through a slot 126 and exits the die 90 at the slot orifice 128. Coating fluid 88 flows from the cavity 100 through the slot 102 and exists at an orifice 104 onto the die face 130. The flow velocity of the fluid 88 from the orifice 104 is not large enough to form a free jet, so it flows down the die face 130 and onto the top of the fluid 114 at the orifice 128. The fluid 114 is flowing at a large velocity and it combines with the fluid 90 to form a composite two layer free kinetic liquid jet 132 including layers 134, 136. The layer 136 of fluid 114 is attached to the die 90 at only the edges of the orifice 128. The composite jet 132 traverses the gap to the driven transfer roll 98 and deposits a two layer coating on its surface. If the slot 126 is horizontal and no obstruction is present, the jet 132 would pass through a perpendicular plane spaced to the right of the orifice 128 exit.

The transfer roll 98 rotates counterclockwise and carries the composite fluid layer 138 on its surface into the nip between the driven roll 96 and the transfer roll 98. The transfer roll 98 carries the web 94 through the nip in a manner such that it contacts the surface of the transfer roll 98. The web removes the composite layer and it is deposited upon the web surface.

The substrate may be a continuous web running at speeds of 10 to 3,000 meters per minute through the coating station, or it may be a discrete sheet, a discrete rigid piece part, or an array of pieces or parts transported through the coating station. The coating layers may be of differing compositions, and have wide variation in viscosity, surface tension, and thickness ratios. The composite layer will have a combination of surface tensions and viscosities so that it will not dewet from the substrate surface after contacting over the surface within the time of transport through the coating station. Examples of coating fluids coatable by this method are monomers, oligomers, solutions of dissolved solids, solid-liquid dispersions, liquid mixtures, and emulsions.

Because both curtain coating and jet coating involve the use of free unsupported moving sheets of fluids, many of the devices and apparatus used to advantage in curtain coating can be used in jet coating. These include edge guides, air baffles, air dams, and edge bead removal devices.

This method can be used in various diverse fields such as to create photographic materials on paper or similar substrates, or to create magnetic media tapes, disks, and other articles.

I claim:

1. A method of coating a substrate with a plurality of layers of coating fluid comprising the steps of:

moving the substrate along a path through a coating station;

forming at least first and second flowing layers of coating fluid;

flowing at least one of the layers from an orifice of a slot of a kinetic jet coater at a velocity that is sufficient to form a continuous, horizontally flowing orifice-exiting kinetic jet;

placing the layers in face-to-face contact with each other to form a composite layer regardless of whether each layer is individually flowing at a velocity that is sufficient to form a continuous flowing fluid kinetic jet;

flowing the composite layer at a velocity that is sufficient to cause the composite layer to form a continuous, horizontally flowing kinetic jet to the substrate for a coating width; and contacting the substrate with the flowing composite layer kinetic jet to deposit the coating fluids on the substrate in a plurality of distinct superposed layers of the coating fluids;

wherein the moving the substrate along a path through a coating station step comprises spacing the substrate from the beginning of the fluid kinetic jet a distance greater than ten times the thickness of the composite layer applied to the substrate.

2. The method of claim 1 wherein the placing the layers step comprises placing the first and second layers in face-to-face contact with each other to form a composite layer within the slot at a velocity that is sufficient to cause the composite layer to form a continuous, horizontally flowing kinetic jet to the substrate for the coating width.

3. The method of claim 1 wherein the placing the layers step comprises, after flowing at least one first coating fluid layer through the slot and outside of the slot, applying at least one second coating fluid layer on the first coating fluid layer to form a kinetic jet of the composite layer without destroying the kinetic jet of the first layer.

4. The method of claim 3 wherein the flowing the composite layer step comprises continuously metering the second coating fluid through a slot of the kinetic jet coater and flowing the second fluid along a face of the coater.

5. The method of claim 3 further comprising the step of selecting flow rate for the first flowing layer of coating fluid in combination with the slot dimensions, density of the fluid, a fluid surface tension, and flow properties of the fluid to form a kinetic jet.

6. The method of claim 1 wherein the flowing the composite layer step comprises forming each layer in a separate die slot of a kinetic jet coater and forming the composite layer external to the die slots as the confluence of the plurality of single layer kinetic jets exiting the respective die portions.

7. The method of claim 1 further comprising the step of depositing the composite layer onto a transfer surface before the contacting the substrate step.

8. The method of claim 1 wherein the fluid kinetic jet is accelerated by at least one of gravitational, magnetic, or electrostatic forces.

9. The method of claim 1 wherein both flowing and contacting steps are performed in a low gravity environment with a gravitational acceleration of less than 980 $cm/s^2$.

10. The method of claim 1 wherein at least one of the coating fluids does not wet the substrate.

11. The method of claim 1 wherein at least one of the coating fluids is not miscible with an adjacent coating fluid.

12. The method of claim 1 wherein at least one of the coating fluids has a surface tension differing from an adjacent coating fluid.

13. The method of claim 1 wherein at least one of the coating fluids is in turbulent flow.

14. A method of coating a substrate with a plurality of layers of coating fluid comprising the steps of:

moving the substrate along a path through a coating station;

forming at least first and second flowing layers of coating fluid;

flowing at least one of the layers from an orifice of a slot of a kinetic jet coater at a velocity that is sufficient to form a continuous, horizontally flowing orifice-exiting kinetic jet;

placing the layers in face-to-face contact with each other to form a composite layer regardless of whether each layer is individually flowing at a velocity that is sufficient to form a continuous flowing fluid kinetic jet;

flowing the composite layer at a velocity that is sufficient to cause the composite layer to form a continuous, horizontally flowing kinetic jet to the substrate for a coating width; and contacting the substrate with the flowing composite layer kinetic jet to deposit the coating fluids on the substrate in a plurality of distinct superposed layers of the coating fluids; and interrupting the coating process without stopping the substrate or ceasing the other steps by blocking the flow before it contacts the web.

15. A kinetic jet coater apparatus for coating a substrate with multiple layers of coating fluid comprising:

a die having a first passageway communicating between a coating fluid source and a die exit;

means for moving the substrate at a spaced distance from the die exit;

means for flowing a first coating fluid from the die exit at a rate that is sufficiently high to cause the coating fluid to exit from the die exit and create a continuous horizontally flowing fluid kinetic jet bridging to the substrate for a coating width when the substrate is a distance greater than ten times the thickness of the composite laver applied to the substrate;

means for flowing at least one second coating fluid layer in face-to-face contact with the coating fluid kinetic jet to form a composite layer kinetic jet bridging to the substrate for the coating width.

16. The apparatus of claim 15 wherein the second coating fluid layer flows together with the first coating fluid through the die exit.

17. The apparatus of claim 15 wherein the die comprises: a first cavity for receiving the first coating fluid, wherein the first passageway is a slot which communicates between the first cavity and a first slot exit; a second cavity for receiving the second coating fluid; and a second slot communicating between the second cavity and a second slot exit; and a third slot for receiving the first and second coating fluids from the respective first and second slot exits and communicating with the die exit; wherein the first and second fluids form a composite layer within the third slot and wherein the third slot is sized to flow the composite layer at a rate that is sufficiently high to cause the composite layer to exit from the die exit and break cleanly free from the die surfaces without contacting more than the edges of the die slot exits regardless of whether the flow rate of the individual first and second fluids in their respective first and second slots is sufficient to form a fluid kinetic jet.

18. The apparatus of claim 15 wherein the flowing means comprises means for flowing at least one coating fluid layer through the die and means for applying at least one additional coating fluid layer on the coating fluid layers that exited the die.

19. The apparatus of claim 15 further comprising a transfer surface located between the die and the substrate, wherein the composite layer fluid kinetic jet travels to the transfer surface and forms a composite layer on the transfer surface, and wherein the composite layer is transferred from the transfer surface to the substrate.

* * * * *